United States Patent [19]

Messer

[11] Patent Number: 4,573,580

[45] Date of Patent: Mar. 4, 1986

[54] UNIT DOSE MEDICATION DISPENSER

[76] Inventor: Michelle Messer, 103 Archibald St., Kansas City, Mo. 64111

[21] Appl. No.: 596,110

[22] Filed: Apr. 2, 1984

[51] Int. Cl.[4] ..... B65D 83/04

[52] U.S. Cl. ..... 206/534; 206/538; 206/459

[58] Field of Search ..... 206/534, 538, 236, 459; 116/308; 220/82 A

[56] References Cited

U.S. PATENT DOCUMENTS

| | | | |
|---|---|---|---|
| 2,252,487 | 8/1941 | Bevill | 116/308 |
| 3,080,964 | 3/1963 | Robinson et al. | 220/82 A |
| 3,424,123 | 1/1969 | Giffard | 116/67 R |
| 4,037,719 | 7/1977 | Perlmutter | 206/236 |
| 4,038,937 | 8/1977 | Moe | 206/538 |
| 4,039,080 | 8/1977 | Cappuccilli | 206/538 |
| 4,057,145 | 11/1977 | Wray et al. | 206/539 |
| 4,318,477 | 3/1982 | Kerpe | 116/308 |

*Primary Examiner*—Joseph Man-Fu Moy
*Attorney, Agent, or Firm*—Klarquist, Sparkman, Campbell, Leigh & Whinston

[57] ABSTRACT

A medication dispenser is disclosed for providing pills to a patient at preselected times of day. The dispenser is comprised of a box-like structure having twenty-eight rectangular receptacles arranged in four rows of seven receptacles each, thereby presenting a matrix of four rows and seven columns. Each of the receptacles can hold a prescribed dose of medication to be taken by a patient at preselected times of day during a week. Each column is labeled with a different day of the week, and each lid is provided with rotatable wheels which can be used to preselect any given time on any given day to dispense medication to a patient.

2 Claims, 3 Drawing Figures

UNIT DOSE MEDICATION DISPENSER

BACKGROUND OF THE INVENTION

The present invention relates to dosage indicating trays or similar holders for individual solid medications such as pills or capsules. More particularly, the invention relates to a pill dispenser for dispensing daily medication, prestored for a week.

Many forms of dispensing containers and other holders for pills have been proposed and commercially introduced. In general, such containers have been relatively complicated or expensive when intended for holding a plurality of different medications to be dispensed at various times over a period of several days. For example, separate fabrication and assembly of a number of relatively movable parts is required in many dispensing pill holders. Others are limited in their ability to provide for the flexible medication dispensing schedules sometimes required by patients.

U.S. Pat. No. 4,039,080 discloses a dosage indicating pill tray having individual compartments for holding pills. Each compartment is rectangular and arranged in a rectangular format of seven columns and a plurality of rows. Each of the columns is labeled with the day of the week, and each row is labeled with a fixed time of the day. This patent clearly demonstrates the significant drawbacks of the prior art in which the times at which pills are to be dispensed during the day cannot be varied. In the '080 patent, pills can only be dispensed at breakfast, lunch, dinner and bedtime.

U.S. Pat. No. 4,126,247 to Majka discloses a pill dispenser which provides a storage space in which pills may be placed. Each storage space corresponds to one day of a given month. This device once again demonstrates the significant drawback of the prior art which does not provide for the administration of medication at varying times during a given day.

Other patents dealing with devices for chronologically dispensing tablets include U.S. Pat. No. 4,204,611; U.S. Pat. No. 3,368,603; U.S. Pat. No. 3,618,559; U.S. Pat. No. 4,275,384; U.S. Pat. No. 3,744,867 and U.S. Pat. No. 4,127,190. None of these patents appear to be as closely related to the instant invention, however, as U.S. Pat. No. 4,039,080 and U.S. Pat. No. 4,126,247.

With the drawbacks of the prior art in mind, it is the principal object of the present invention to provide a unit dose medication dispenser in which medication can be stored for a week at a time.

A further object is to provide a holder for solid medications in which the time of day at which medication is to be dispensed can be varied.

Another object is to provide a pill tray having individual compartments for holding a week's supply of medication in which the time of day at which medication can be dispensed can be conveniently varied.

Other objects will in part be obvious from the following description of the invention.

SUMMARY OF THE INVENTION

In accordance with the foregoing objects, the invention comprises a unit dose medication dispenser for providing pills to a patient at preselected times of day. The dispenser is rectangular in outline, and is provided with twenty-eight rectangular receptacles arranged in four rows of seven receptacles each, which presents a matrix of four rows and seven columns. Each receptacle is provided with a liftable lid hingedly attached to the top of one of the receptacles. Each lid is further provided with a pair of wheels which can be easily manipulated with the fingers to display a given time of day or night at which medication is to be dispensed.

DETAILED DESCRIPTION OF THE PREFERRED EMBODIMENT

Figure 2:
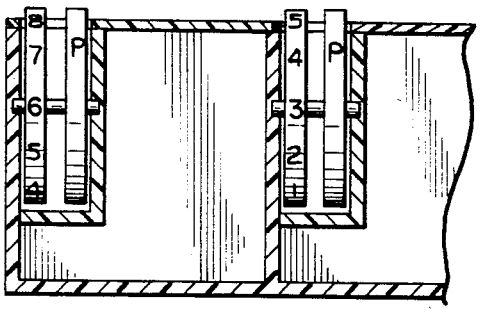
FIG. 2 is an enlarged, fragmentary cross-sectional view of two of the compartments shown in FIG. 1.

A Unit Dose medication dispenser 10 is shown which provides pills to a patient at preselected times of day. Dispenser 10 is comprised of a rigid, rectilinear container 12 comprised of 28 rectangular receptacles 14 (see FIG. 2) arranged in four rows of seven receptacles each, thereby presenting a matrix of four rows and seven columns. Container 12 and receptacles 14 are made of plastic, or any other similar lightweight and durable material.

Each receptacle 14 is further comprised of a bottom 16, upwardly extending sidewalls 18, and a liftable, flat lid 20 hingedly attached to the top of one of the sidewalls by means of a crease or indentation 22. Each lid 20 is provided with a tab 24 to facilitate lifting of lid 20 to expose receptacle 14.

Above the top row of receptacles 14 a row of labels 26 are attached. One of these labels designates the first column of receptacles 14 as being reserved for Sunday, the second column is labeled Monday, the third column is labeled Tuesday, the fourth column is labeled Wednesday, the fifth column is labeled Thursday, the sixth column is labeled Friday, and the seventh column is labeled Saturday.

Each lid is further provided with a means for designating each box with a time of day. In the first embodiment of the invention shown in FIGS. 1 and 2, this means is comprised of a subcompartment 28 within each receptacle 14. First and second substantially parallel and vertically oriented wheels 30, 32 are disposed within each subcompartment 28, and a substantially horizontally oriented spindle 34 is fixed within each subcompartment. Spindle 34 is placed in rotating engagement within circular indentations (not shown) within the upright walls of subcompartment 28. The indentations occur at opposing portions of the upright walls of subcompartment 28 so that spindle 34 is horizontally oriented. Wheels 30, 32 are rotatably mounted on spindle 34 by placement of spindle 34 through a central circular aperture (not shown) in each of wheels 30, 32. The diameter of the wheels 30, 32 is only slightly greater than the outer diameter of spindle 34 such that there is slight frictional engagement between the walls of the aperture in wheels 30, 34 and spindle 34. This frictional engagement is great enough that wheels 30, 32 will rotate in response to pressure exerted by a human finger or other instrument being manipulated by the human finger. The frictional engagement will be great enough, however, to prevent wheels 30, 32 from freely rotating about spindle 34. This arrangement permits wheels 30, 32 to be selectively adjusted to a time of day without fear that wheels 30, 32 will continue to rotate and change the preselected time at which medication is to be dispensed.

The arcuate, outside wall of wheel 30 is imprinted with numbers representing the hours of the day. The arcuate wall of wheel 32 is imprinted with letters representing a.m. and p.m. Conventional embodiments of wheel 32 provide for the letter "a" or "p" to be imprinted on the wheel to provide the designations for a.m. and p.m.

Each lid 20 is further provided with a cut-away portion or window 36 through which a single number in its entirety and a single letter in its entirety may be seen when wheels 30, 32 are set to a desired time of day at which medication is to be dispensed.

In operation, a nurse or other licensed person fills the receptacles with appropriate medication in accordance with a prescription from a doctor. A doctor's prescription will usually designate that medication be dispensed daily (usually at 9:00 a.m.), bid (twice a day), tid (three times per day), qid (four times per day), q6° (every six hours), or q8° (every eight hours). The exact times at which the medication is dispensed will vary with the lifestyle of the patient. Someone who is an early riser and on a quid schedule may choose a 9:00 a.m., 3:00 p.m., 9:00 p.m., 3:00 a.m. medication dispensing schedule instead of a more usual 6:00 a.m., 12:00 noon, 6:00 p.m., 12:00 a.m. schedule. The exact dispensing schedule is left up to the discretion of the nurse or caretaker of the patient who is filling the medication dispenser.

Figure 1:
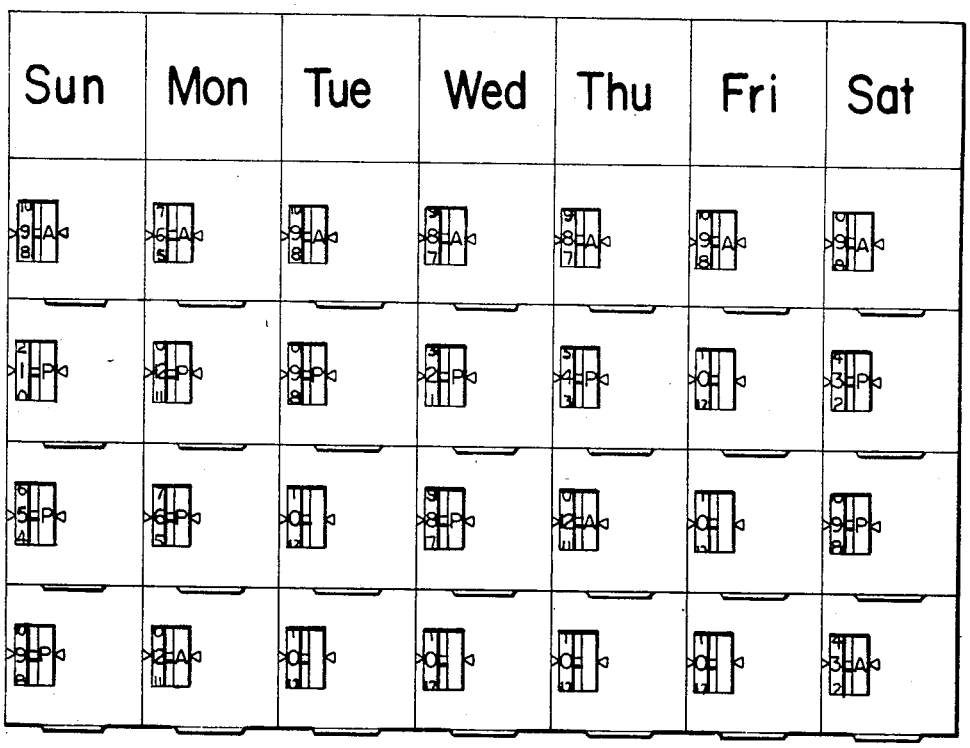
FIG. 1 is a plan view of the pill tray of the instant invention.

FIG. 1 demonstrates some of the various schedules on which patients may take medication. For example, the first column labeled Sunday shows a schedule of dispensing medication at 9:00 a.m., 1:00 p.m., 5:00 p.m. and 9:00 p.m. The column labeled Monday designates a dispensing schedule of 6:00 a.m., 12:00 p.m., 6:00 p.m. and 12:00 a.m. The column labeled Tuesday demonstrates a bid schedule in which medication is dispensed only at 9:00 a.m. and 9:00 p.m. The column labeled Wednesday demonstrates a tid schedule in which medication is dispensed at 8:00 a.m., 2:00 p.m. and 8:00 p.m. The column labeled Friday demonstrates a daily schedule in which pills are to be dispensed only at 9:00 a.m. The other lids 20 are designated with zeros on Friday to indicate that no medication is to be dispensed at any other times.

Once the nurse or other licensed caretaker has devised a schedule for dispensing the medication, tabs 24 are engaged with the fingers and lifted upwardly about crease 22. Medication can then be placed in each of receptacles 14, and wheels 30, 32 are manually adjusted to designate the time of day at which medication is to be dispensed.

The patient or the patient's caretaker merely needs to consult the medication dispenser to determine when pills are to be taken on any given day during a week. Once pills are placed in the containers by a nurse or other licensed individual, an unlicensed caretaker is authorized by law to simply remove the medication from the individual receptacle at the time designated on the lid.

Figure 3:
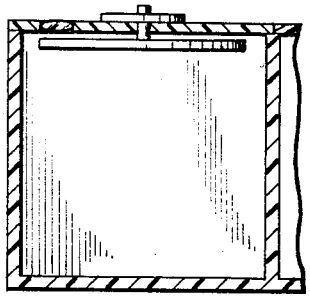
FIG. 3 is an enlarged, fragmentary, cross-sectional view of a second embodiment of the compartment.

In a second embodiment (FIG. 3), receptacles 50 are comprised of a bottom 52 and upwardly extending sidewalls 54. A liftable lid 56 is hingedly attached to the top of one of the sidewalls 54 along a crease (not shown) similar to crease 22 described above. Each lid 56 is provided with a tab (not shown, but similar to tab 24 described above) to facilitate lifting of lid 56.

Each column is designated with a different day of the week, as described in the first embodiment above. The means for designating each lid with a specified time of day is, however, different. The time designating means is comprised of a spindle 60 placed in snug engagement within a bore (not shown) through each of said lids, each terminus of the spindle extending beyond the surfaces 62, 64 of lid 56. A large diameter wheel 66 is rotatably mounted on the terminus of spindle 60 protruding outwardly from surface 64 of lid 56. A smaller diameter wheel 68 is mounted fixedly on the terminus of spindle 60 protruding outwardly from the top 62 of lid 56. Wheels 66, 68 are thereby held in substantially parallel relationship and can rotate relative to each other. Wheels 66, 68, have central apertures (not shown) through which spindle 60 is mounted. The aperture of wheels 66, 68 is only slightly larger than the outer diameter of spindle 60, thereby maintaining spindle 60 and the aperture in wheels 66, 68 in frictional engagement. A keep can, in preferred embodiments, be placed around spindle 60 on top of wheel 68 and below wheel 66 to affix wheels 66, 68 to the spindle. This arrangement permits wheels 66, 68 to be rotated freely by manual manipulation.

The flat face of wheel 66 which is adjacent the bottom 64 of lid 56 is imprinted with numbers representing the hours of the day (1–12) and zero. The flat, top face of wheel 68 which faces away from lid 56 is imprinted with letters representing a.m. or p.m. In especially preferred embodiments, these designations are simply the letter "A" or "P".

Each lid 56 is provided with a cutaway portion through which a single number in its entirety may be seen. The number imprinted on the face of wheel 66 which is most adjacent surface 64 is alignable with a letter on wheel 66 to indicate a desired time of day at which medication is to be dispensed. In the embodiment of the invention shown in FIG. 3, a magnifying lens 70 is fixed within the cutaway portion of lid 56 through which the numbers representing the hours of the day are optically enlarged. The embodiments employing lens 70 are especially desirable when patients using the dispenser are elderly and/or have impaired vision.

I claim:

1. A unit dose medication dispenser to provide pills to a patient at preselected times of day, said dispenser comprising:

a rigid, rectilinear container comprised of rectangular receptacles arranged in rows of seven receptacles each, thereby presenting a matrix of rows and seven columns;

each receptacle being further comprised of a bottom, four upwardly extending sidewalls, and a liftable flat lid hingedly attached to the top of one of the sidewalls, each lid being provided with a tab to facilitate lifting of the lid;

means for designating each column with a different day of the week and each lid selectively with a time of the day before noon and after noon, wherein said means for designating each lid with the time of the day is comprised of a subcompartment within each receptacle, first and second substantially parallel and vertically oriented wheels disposed within said subcompartment, and a substantially horizontally oriented spindle fixed within said subcompartment on which said wheels are rotatably mounted for independent rotation, the arcuate wall of said first wheel further being imprinted with numbers representing the hours of the day, the arcuate wall of said second wheel being imprinted with letters representing a.m. and p.m., each lid being provided with a cut-away portion through which a single number in its entirety and a single letter in its entirety may be seen when said wheels are set to a desired time of day at which medication is to dispensed.

2. A unit dose medication dispenser to provide pills to a patient at preselected times of day, said dispenser comprising:

a rigid, rectilinear container comprised of rectangular receptacles arranged in rows of seven receptacles each, thereby presenting a matrix of rows and seven columns, each receptacle being further comprised of a bottom, four upwardly extending side walls, and a liftable flat lid hingedly attached to the top of one of the sidewalls, each lid being provided with a tab to facilitate lifting of the lid;

means for designating each column with a different day of the week and each lid with a time of the day, wherein said means for designating each lid with the time of day is comprised of a spindle placed in snug engagement within a bore through each of said lids, each terminus of the spindle extending beyond the surface of the like, first and second substantially parallel wheels rotatably mounted for independent rotation on said spindle on opposite faces of the lid, said first wheel having a larger diameter than said second wheel and being mounted on the face of the lid adjacent the interior of the compartment, said second wheel being mounted on the opposite face of said lid, the flat face of said first wheel adjacent the lid being imprinted with numbers representing the hours of the day and the flat top face of said second wheel adjacent the lid being imprinted with letters representing a.m. or p.m., each lid being provided with a cut-away portion through which a single number in its entirety may be seen, the number imprinted on said first wheel and the letter on said second wheel being alignable to indicate a desired time of day at which medication is to be dispensed.

* * * * *